US010548436B2

(12) United States Patent
Miura

(10) Patent No.: US 10,548,436 B2
(45) Date of Patent: Feb. 4, 2020

(54) TISSUE WIPE CONTAINER

(71) Applicant: DAIO PAPER CORPORATION, Ehime (JP)

(72) Inventor: Akiteru Miura, Ehime (JP)

(73) Assignee: DAIO PAPER CORPORATION, Ehime (JP)

( * ) Notice: Subject to any disclaimer, the term of this patent is extended or adjusted under 35 U.S.C. 154(b) by 4 days.

(21) Appl. No.: 16/085,041

(22) PCT Filed: Feb. 22, 2017

(86) PCT No.: PCT/JP2017/006580
§ 371 (c)(1),
(2) Date: Sep. 14, 2018

(87) PCT Pub. No.: WO2017/169326
PCT Pub. Date: Oct. 5, 2017

(65) Prior Publication Data

US 2019/0104894 A1 Apr. 11, 2019

(30) Foreign Application Priority Data

Mar. 30, 2016 (JP) ..... 2016-067119

(51) Int. Cl.
*A47K 10/32* (2006.01)
*B65D 83/08* (2006.01)
(Continued)

(52) U.S. Cl.
CPC ..... *A47K 10/32* (2013.01); *A47K 10/38* (2013.01); *A47K 10/3818* (2013.01);
(Continued)

(58) Field of Classification Search
CPC .... B65D 83/0894; B65D 43/02; B65D 53/00; B65D 85/62; A47K 10/42
(Continued)

(56) References Cited

U.S. PATENT DOCUMENTS 3,092,439 A * 6/1963 Harrison ..... B26F 1/00 264/154
5,699,912 A * 12/1997 Ishikawa ..... A47K 10/421 206/494
(Continued)

FOREIGN PATENT DOCUMENTS

JP S49-11227 3/1974
JP S54-170952 12/1979
(Continued)

OTHER PUBLICATIONS

International Search Report for PCT/JP2017/006580 dated Apr. 11, 2017.

*Primary Examiner* — Rakesh Kumar
(74) *Attorney, Agent, or Firm* — IPUSA, PLLC

(57) ABSTRACT

A tissue wipe container includes a case having a dispensing unit and a lid attached to the case such as to expose and cover the dispensing unit, wherein the dispensing unit has an engaging part for engaging the dispensing unit with the case, and has a flat plate part having one or more cuts made thereinto that serve as an opening through which tissue wipes are passed, wherein the flat plate part includes a plurality of flexible parts, which are elastically deformable and separated from each other by the one or more cuts, and each of which has a distal end situated toward a center of the opening and a proximal end situated away from the center of the opening, wherein the engaging part has a constricted portion formed in a side surface of the dispensing unit at a center in a vertical direction along a circumferential direction, an edge of a mount opening of the case being inserted into the constricted portion to cause the engaging part to be engaged with the mount opening, and wherein the plurality of flexible parts are such that a thickness of the distal end is thinner than a thickness of the proximal end.

7 Claims, 6 Drawing Sheets

(51) Int. Cl.
*A47K 10/38* (2006.01)
*B65D 25/52* (2006.01)

(52) U.S. Cl.
CPC ..... *B65D 25/52* (2013.01); *B65D 83/08* (2013.01); *B65D 83/0805* (2013.01); *A47K 2010/3233* (2013.01); *A47K 2010/3266* (2013.01)

(58) Field of Classification Search
USPC ..... 221/26
See application file for complete search history.

(56) References Cited

U.S. PATENT DOCUMENTS 5,718,353 A * 2/1998 Kanfer ..... A47K 10/3818 206/812
6,279,775 B1 * 8/2001 Parkes ..... A47K 10/3818 221/185
6,364,101 B1 * 4/2002 Schultz ..... A47K 10/3818 206/210
6,394,298 B1 * 5/2002 Zaidman ..... A47K 10/421 206/494
7,303,069 B2 * 12/2007 Forrest, Jr. ..... B08B 1/00 206/210
8,944,279 B2 * 2/2015 Shoaf ..... A47K 10/421 206/204
9,101,250 B2 * 8/2015 Ray ..... A47K 10/24
9,498,091 B2 * 11/2016 Yamada ..... B65D 75/5894
9,969,538 B1 * 5/2018 Carr ..... B65D 47/06
2002/0179627 A1 12/2002 Huang et al.
2009/0314793 A1 * 12/2009 Reedy ..... B60R 7/084 221/45
2010/0078443 A1 * 4/2010 Hoefing ..... A47K 10/3818 221/45
2012/0145737 A1 * 6/2012 Ray ..... A47K 10/3818 221/45
2013/0240556 A1 * 9/2013 Yamada ..... B65D 75/5894 221/63
2014/0190983 A1 * 7/2014 Sanguinet ..... A47K 10/3818 221/63
2014/0367400 A1 * 12/2014 Crudge ..... A47K 10/3818 221/1
2015/0305579 A1 * 10/2015 Azelton ..... A47K 10/42 221/63

FOREIGN PATENT DOCUMENTS

JP S62-161673 U 10/1987
JP 2005-53529 3/2005
JP 2005053529 A * 3/2005 ..... B65D 83/08
JP 2005-515939 6/2005
JP 2010-N02440 * 7/2009 ..... B65D 83/08
JP 2010-247899 11/2010
JP 2012-192962 10/2012

* cited by examiner

TISSUE WIPE CONTAINER

TECHNICAL FIELD

The disclosures herein relate to a tissue wipe container for storing tissue wipes.

BACKGROUND ART

Conventionally, tissue wipe containers for storing tissue wipes for wiping a house floor, a toilet, a human body, etc. are known in the art.

One type of a tissue wipe container known in the art has a configuration in which a dispensing hole shaping member is detachably attached to the dispensing opening of the container to provide resistance to tissue wipes, thereby causing a tissue wipe to be cut along a perforation formed in the tissue wipes (see Patent Document 1, for example).

RELATED-ART DOCUMENTS

Patent Document

[Patent Document 1] Japanese Patent Application Publication No. 2012-192962

SUMMARY OF THE INVENTION

Problem to be Solved by the Invention

The configuration disclosed in Patent Document 1 noted above is such that the dispensing hole shaping member is attached to the dispensing opening from below, so that the dispensing hole shaping member readily falls if pressed from above. When a next tissue wipe is difficult to pull out through the dispensing opening, for example, fumbling for removal of the tissue wipe may cause the dispensing hole shaping member to fall into the container. When this happens, the tissue wipe may be separated from the dispensing hole shaping member. In such a case, additional labor is required to reattach the tissue wipe to the dispensing hole shaping member and then to reattach the dispensing hole shaping member to the dispensing opening, which prevents effortless removal of a tissue wipe.

In consideration of the above, it may be preferable to provide a tissue wipe container that allows an easy removal of a tissue wipe while enabling the satisfactory retention of tissue wipes.

Means to Solve the Problem

According to an embodiment, a tissue wipe container includes a case which stores therein a roll of tissue wipes with perforations and which is provided with a dispensing unit for pulling out the stored tissue wipes to an outside upon being separated along the perforations, and a lid attached to the case in such a manner as to expose and cover the dispensing unit, wherein the dispensing unit has an engaging part for engaging the dispensing unit with the case, and has a flat plate part having one or more cuts made thereinto that serve as an opening through which tissue wipes are passed, wherein the flat plate part includes a plurality of flexible parts, which are elastically deformable and separated from each other by the one or more cuts, and each of which has a distal end situated toward a center of the opening and a proximal end situated away from the center of the opening, wherein the engaging part has a constricted portion formed in a side surface of the dispensing unit at a center in a vertical direction along a circumferential direction, an edge of a mount opening of the case being inserted into the constricted portion to cause the engaging part to be engaged with the mount opening, and wherein the plurality of flexible parts are such that a thickness of the distal end is thinner than a thickness of the proximal end.

Advantage of the Invention

According to at least one embodiment, a tissue wipe container is provided that allows an easy removal of a tissue wipe while enabling the satisfactory retention of tissue wipes.

MODE FOR CARRYING OUT THE INVENTION

In the following, specific embodiments of a tissue wipe container will be described in detail with reference to accompanying drawings. It should be noted that the scope of the invention is not limited to the illustrated examples.

Figure 1:
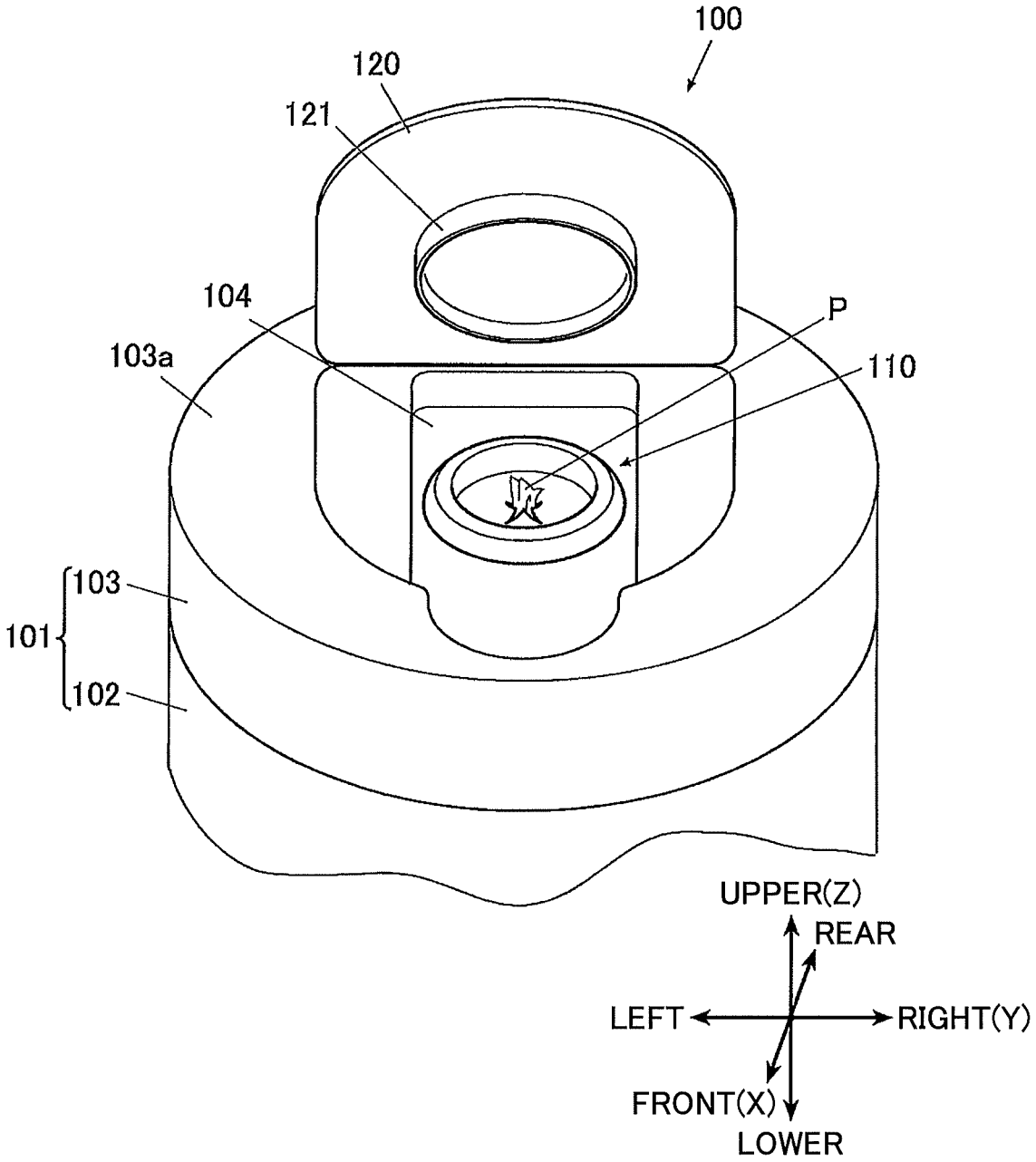
FIG. 1 is an axonometric view of a tissue wipe container according to a present embodiment as viewed from the front and above.
Figure 2:
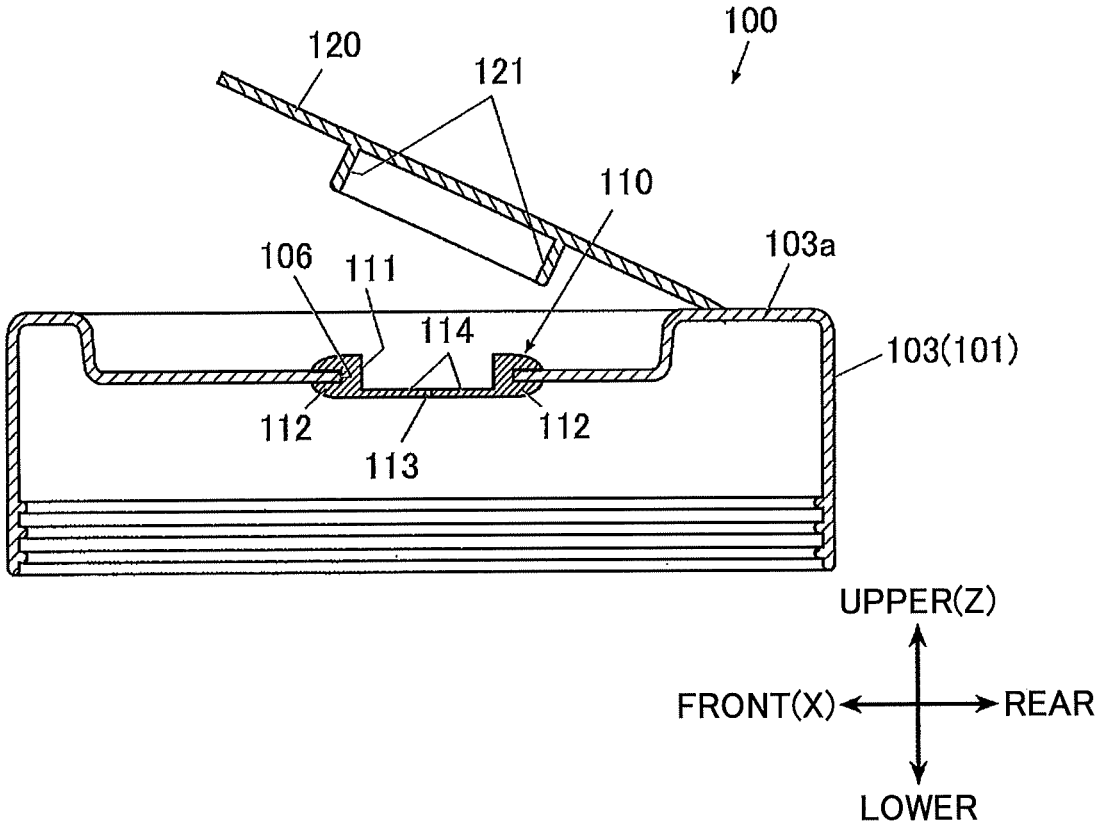
FIG. 2 is a cross-sectional view illustrating a cap that is an upper part of a case of the tissue wipe container.
Figure 3:
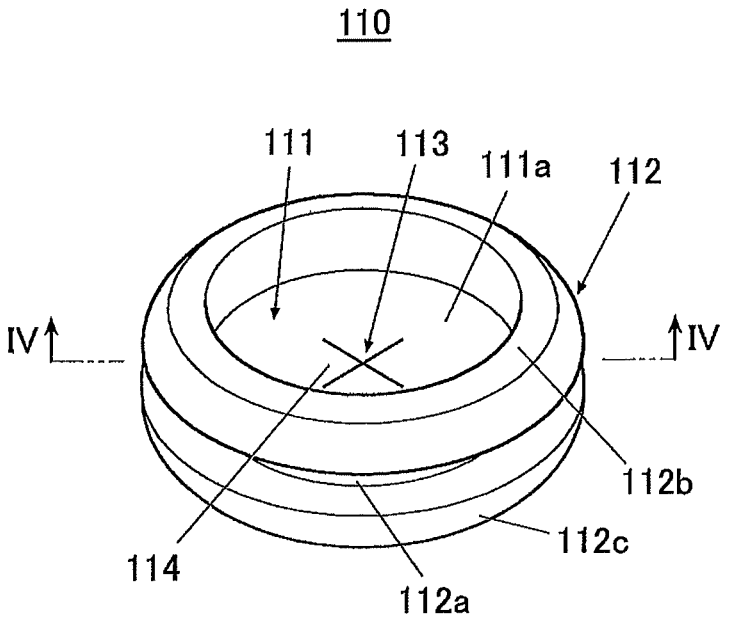
FIG. 3 is an axonometric view illustrating a dispensing unit of the tissue wipe container.
Figure 4:
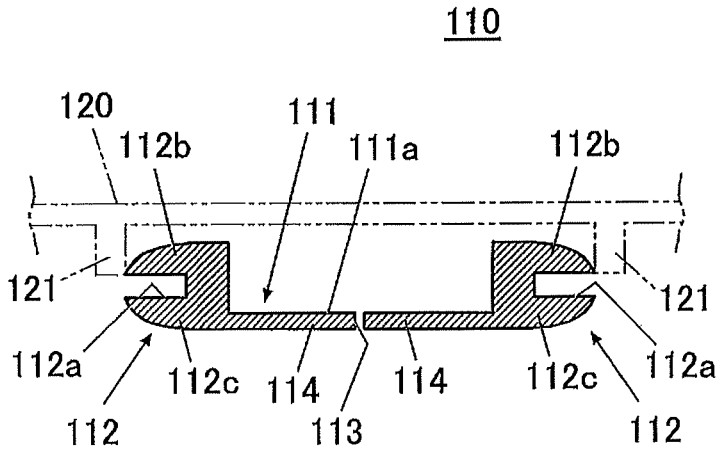
FIG. 4 is a schematic cross-sectional view taken along the line IV-IV illustrated in FIG. 3.
Figure 5:
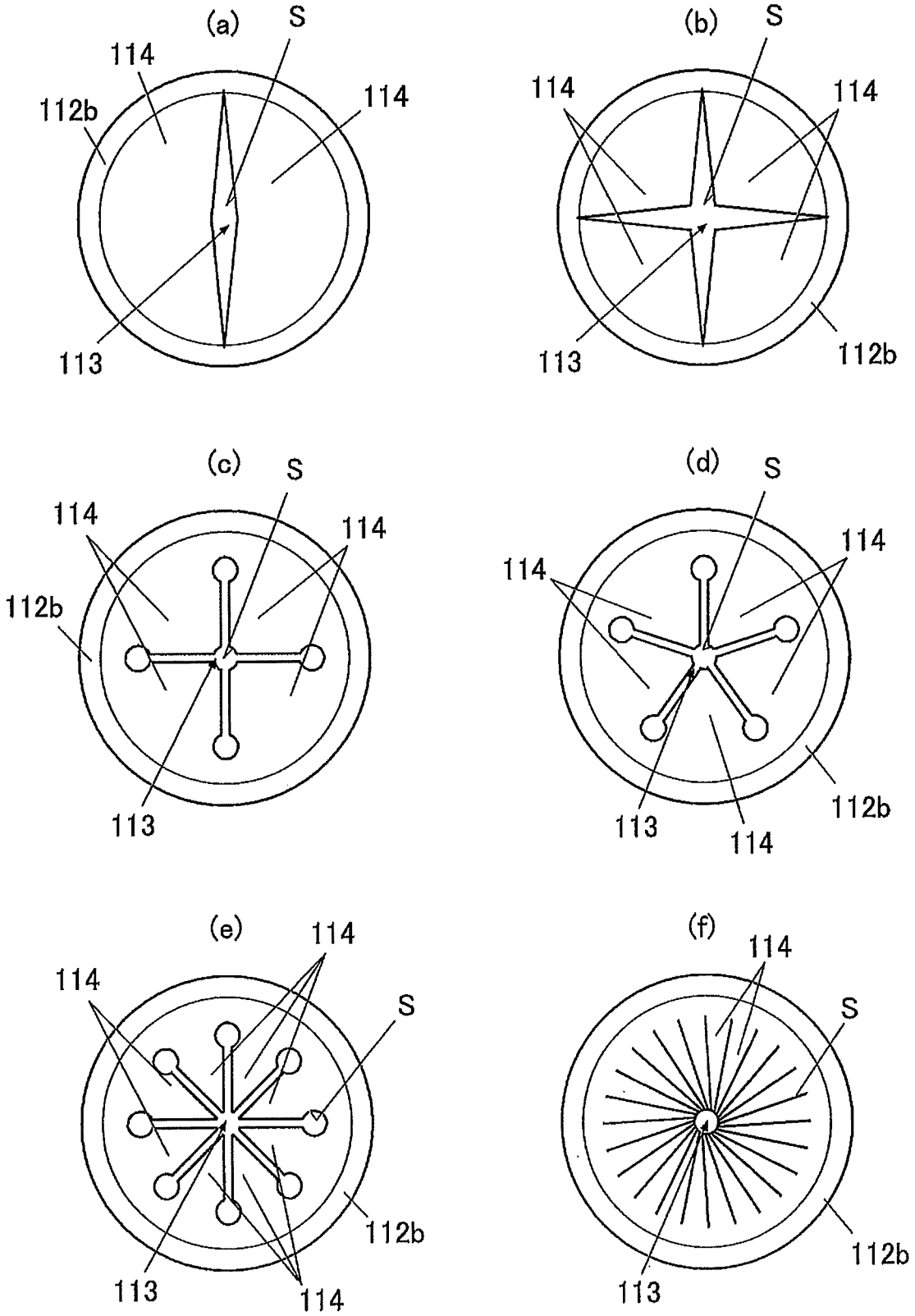
FIG. 5 is a drawing illustrating preferred embodiments of the dispensing unit.
Figure 6:
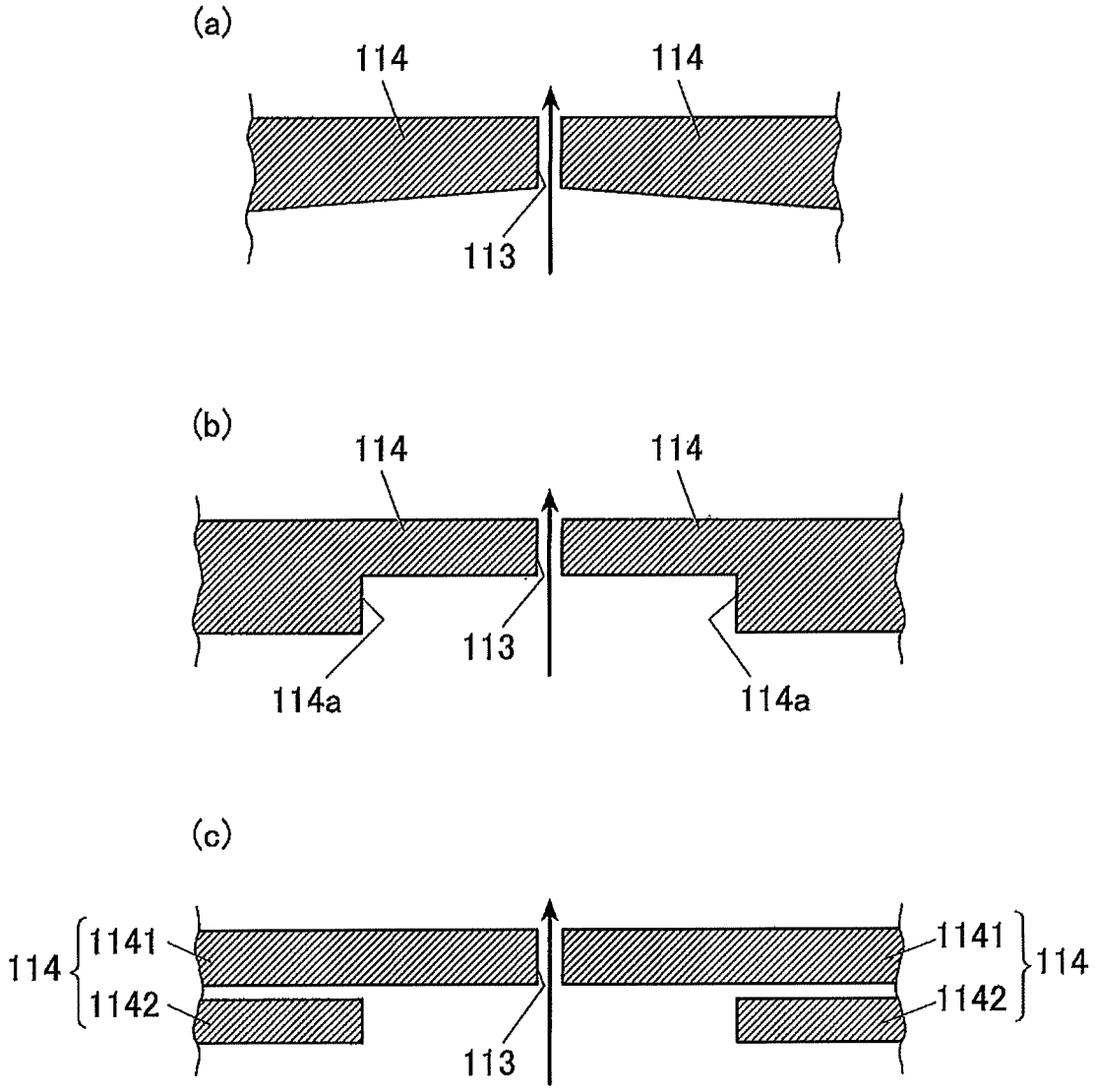
FIG. 6 is a drawing illustrating preferred embodiments of the dispensing unit.
Figure 7:
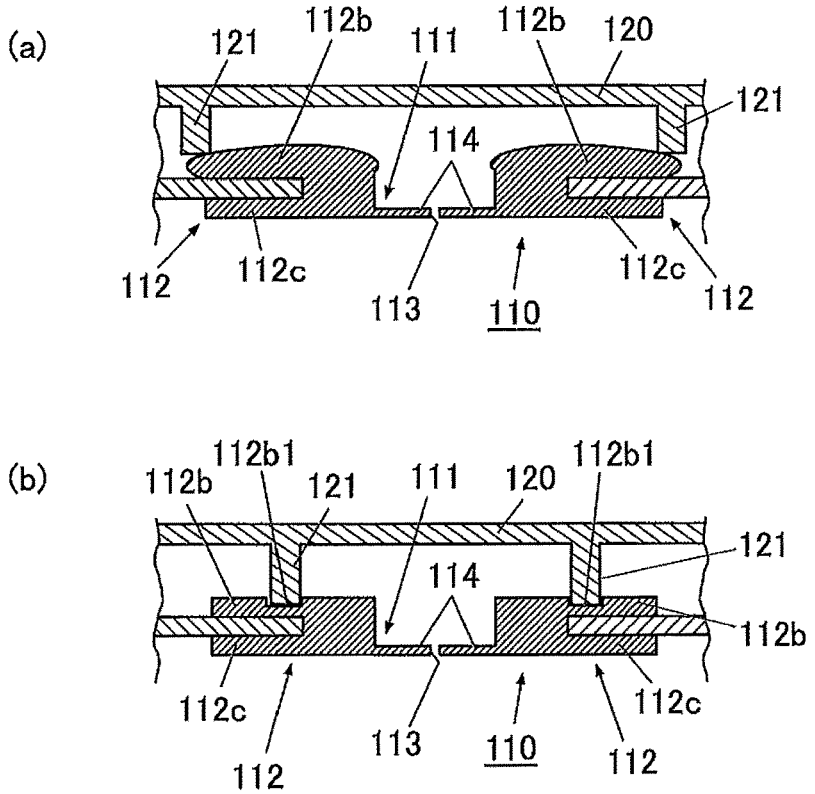
FIG. 7 is a drawing illustrating preferred embodiments of the dispensing unit.

FIG. 1 is an axonometric view of a tissue wipe container 100 illustrated as an example of an embodiment as viewed from the front and above. FIG. 2 is a cross-sectional view of a cap 103 that is an upper part of a case 101 of the tissue wipe container 100. FIG. 3 is an axonometric view illustrating a dispensing unit 110 of the tissue wipe container 100. FIG. 4 is a schematic cross-sectional view taken along the line IV-IV illustrated in FIG. 3. FIG. 5 through FIG. 7 are drawings illustrating the preferred embodiments of the dispensing unit 110.

In FIG. 1, the illustration of a lower part (i.e., bottom part) of a bottle 102 is omitted.

The tissue wipe container 100 contains a roll of tissue wipes P (e.g., a roll of wet sheets, or a roll of paper such as wet tissues) therein, for example. As illustrated in FIG. 1 and FIG. 2, the tissue wipe container 100 includes the case 101 provided with the dispensing unit 110 for removing the stored tissue wipes P to the outside, and also includes the lid 120 serving as a lid member attached to the case 101 to cover and expose the dispensing unit 110.

A roll of the tissue wipes P contained in the tissue wipe container 100 has perforations formed at constant intervals in the lengthwise direction, thereby allowing a user to use a tissue wipe P having a size cut along a perforation.

In the following description, the front-and-rear direction of the tissue wipe container 100 is referred to as the X-axis direction. The side at which the lid 120 is supported by the case 101 (or the cap 103) is referred to as the rear side, and the opposite side is referred to as the front side. The right-and-left direction (i.e., widthwise direction) in a front view is referred to as the Y-axis direction, and the vertical direction is referred to as the Z-axis direction.

The case 101 includes the bottle 102 serving as a lower part of the case 101 and having a cylindrical shape with a solid base, and includes the cap 103 serving as an upper part of the case 101.

The upper end of the bottle 102 has an opening, and the outer peripheral surface of the upper end of the bottle 102 has a male thread (not shown) formed along the circumferential direction.

The bottle 102 is made of PE (polyethylene), PP (polypropylene), PET (polyethylene terephthalate), or an ABS resin, for example.

The cap 103 is a cylindrical shape having an upper face 103*a* and an open bottom. The inner peripheral surface of the open lower end has a female thread formed thereon for threadable engagement with the male thread of the bottle 102.

The cap 103 is made of PE (polyethylene), PP (polypropylene), PET (polyethylene terephthalate), or an ABS resin, for example.

The case 101 has a linked structure such that the bottle 102 and the cap 103 are detachably linked through the mail thread and the female thread. The cap 103 is detachable from the bottle 102. While the cap 103 is removed from the bottle 102, the tissue wipes P may be placed inside the bottle 102, or the tissue wipes P may be removed from the inside.

In the present embodiment, the tissue wipes P, which are rolled around an axis extending in the vertical direction (i.e., Z-axis direction), are placed in the case 101.

The upper face 103*a* of the cap 103 serving as a part of the case 101 is provided with the dispensing unit 110 for pulling out the tissue wipes P placed inside the case 101 to the outside of the case 101, and provided with the lid 120 pivotally mounted on the cap 103 to cover and expose the dispensing unit 110.

The dispensing unit 110 is situated further toward the front side in the front-and-rear direction (i.e., X-axis direction) than the proximal end of the lid 120. Namely, the lid 120 is pivotally mounted to the upper face 103*a* of the cap 103 at the rear side of the dispensing unit 110. The lid 120 covers the dispensing unit 110 from the rear side.

The dispensing unit 110 is disposed in a mount opening 106 that is formed substantially at the center of a recess 104 made in the upper face 103*a* of the cap 103.

The dispensing unit 110 is an elastically deformable member made of silicon rubber, for example. Silicon rubber is superior in durability. Even in the case in which the tissue wipes P are replenished to repeatedly use the tissue wipe container 100, the elastic deformability of the dispensing unit 110 is maintained so as to allow the tissue wipes P to be comfortably pulled out over a long period of time. Further, due to its superior chemical resistance, silicon rubber is not altered by alcohol or the like contained in the chemical solution present in the wet-type tissue wipes P.

The material used for the dispensing unit 110 is not limited to a silicon rubber, and may be a styrene-butadiene, polyester, polyethylene, or urethane thermoplastic elastomer, which is a soft resin material. Alternatively, any other resin material may be used to form the dispensing unit 110.

As illustrated in FIG. 3 and FIG. 4, the dispensing unit 110 is a circular shape in a top plan view, and the shape in a side elevation view has a cut made into the side surface at the center in the vertical direction.

The dispensing unit 110 has a recess 111 formed at the center of the upper face of the dispensing unit 110, an engaging part 112 formed around the outer perimeter of the dispensing unit 110, a dispensing opening 113 formed through a base 111*a* of the recess 111, and a plurality of flexible parts 114 that are elastically deformable.

The recess 111 is formed such that a center area is recessed in the vertical direction from the circumferential edge of the upper face of the dispensing unit 110, thereby having a circular shape in a top plan view. The base 111*a* of the recess 111 is a planar shape. The dispensing opening 113 is formed through the base 111*a*.

The engaging part 112 has a constricted portion 112*a* constricted in the radial direction and formed in the side surface of the dispensing unit 110 at the center in the Z-axis direction along the circumferential direction, an upper annular portion 112*b* situated at the upper side of the constricted portion 112*a*, and a lower annular portion 112*c* situated at the lower side of the constricted portion 112*a*. The engaging part 112 is engaged with the mount opening 106 by inserting the edge of the mount opening 106 into the constricted portion 112*a* such that the edge of the mount opening 106 is sandwiched between the upper annular portion 112*b* and the lower annular portion 112*c*, thereby fixedly mounting the dispensing unit 110 to the cap 103.

The lengths of the upper annular portion 112*b* and the lower annular portion 112*c* in the Y direction may be the same, or one of these may be longer than the other.

Making the diameter of the lower annular portion 112*c* greater than that of the upper annular portion 112*b* (i.e., making the lower annular portion 112*c* longer than the upper annular portion 112*b* in a side elevation view) makes it unlikely for the dispensing unit 110 to disengage from the mount opening 106 even when a force is applied to the dispensing unit 110 from below during the removal of the tissue wipes P. In contrast, making the upper annular portion 112*b* longer than the lower annular portion 112*c* makes it unlikely for the dispensing unit 110 to fall when a force is applied to the dispensing unit 110 from above.

The dispensing opening 113, which is for pulling out the tissue wipes P placed inside the case 101, is formed by making one or more cuts S (see FIG. 5) into the base 111*a* of the recess 111. At the same time, a plurality of flexible parts 114 are also formed. More specifically, the base 111*a* (i.e., flat plate part) of the recess 111 of the dispensing unit 110 has one or more cuts S that are an opening (i.e., the dispensing opening 113) through which the tissue wipes P are passed. The base 111*a* (i.e., flat plate part) includes the flexible parts 114, which are separated from each other by the one or more cuts S, and each of which is an elastically deformable piece having a distal end situated toward the center of the opening and a proximal end situated away from the center of the opening.

The total length of the cuts S (i.e., the length in the Y direction) may be set to approximately 15 mm, which is greater than the width of an index finger of a typical user, for example.

The flexible parts 114 are formed as mutually separated parts of the base 111*a* by making one or more cuts S into the base 111*a* of the recess 111 at the time of forming the dispensing opening 113. Namely, the gaps between the flexible parts 114 constitute the dispensing opening 113. The tissue wipes P are inserted through the gaps between the flexible parts 114 (i.e., through the dispensing opening 113) to be pulled and dispensed to the outside.

When this is done, the flexible parts 114 are deformed by a force applied in the vertical direction, so that the flexible parts 114 bent by a force applied from below provides a resistance to the tissue wipes P when the tissue wipes P are pulled out. This arrangement makes it easier for a tissue wipe P to be separated along a perforation, and, at the same time, causes the next tissue wipe P to remain at the dispensing opening 113 due to the restoration force.

The number of flexible parts 114 may be two to four, for example, as illustrated in FIG. 5-(*a*) through FIG. 5-(*c*), and may more preferably be five or more as illustrated in FIG. 5-(*d*) through FIG. 5-(*e*). Use of five or more flexible parts 114 provides an increased resistance to the tissue wipes P, thereby making it further easier for the tissue wipes P to be readily separated along a perforation.

As illustrated in FIG. 5-(*f*), the cuts S may be tilted relative to the radial direction of the circular-shaped base 111*a*, thereby increasing a resistance provided to the tissue wipes P. Further, the cuts S may be made along curves to increase a resistance provided to the tissue wipes P.

The flexible parts 114 preferably have distal ends whose thickness is thinner than the thickness of the proximal ends.

Specifically, as illustrated in FIG. 6-(*a*), for example, the lower face of the flexible parts 114 may be provided at an angle relative to the upper face, such that the thickness decreases toward the tip in a side elevation view. Alternatively, the upper face of the flexible parts 114 may be provided at an angle relative to the lower face in a side elevation view.

As illustrated in FIG. 6-(*b*), steps 114*a* may be provided between the distal ends and the proximal ends at the lower face of the flexible parts 114, thereby making the distal ends thinner than the proximal ends. Alternatively, the steps 114*a* may be provided between the distal ends and the proximal ends at the upper face of the flexible parts 114.

As illustrated in FIG. 6-(*c*), each of the flexible parts 114 may be configured such that a plurality (two in this example) of separate sheets 1141 and 1142 having different lengths are stacked one over another such as to provide a thicker proximal end (such as to provide a relatively large number of stacked sheets at the proximal end). In this example, the shorter sheet 1142 is situated below the longer sheet 1141. Alternatively, the shorter sheet 1142 may be situated above the longer sheet 1141.

Configuring the thickness of the flexible parts 114 in the above-noted manners makes the flexible parts 114 easily bendable, thereby further increasing a resistance provided to the tissue wipes P being pulled out.

The lid 120, which is supported by a rotation axis (not shown) extending in the Y-axis direction on the upper face 103*a* of the cap 103, for example, is pivotally attached to the upper face 103*a* so as to be switched between the open state and the closed state.

The lid 120 is configured to be kept at a stable position in each of the open-state placement and the closed-state placement. Namely, the lid 120 is urged toward the closed position upon being brought closer to the dispensing unit 110 than a predetermined rotation angle (see FIG. 2, for example) within the movable range, for example. The lid 120 is also urged to the open position upon being moved further away from the dispensing unit 110 than the predetermined rotation angle.

The lid 120 is not limited to the configuration in which support is provided by the rotation axis on the upper face 103*a*, and may alternatively be formed together with the cap 103, for example. Specifically, the lid 120 may be made by making a cut into the upper face 103*a* of the cap 103. At the proximal end of the lid 120, a fold line may be made by thinning the thickness of the upper face 103*a* along the Y-axis direction. This arrangement may enable folding along the fold line extending in the Y-axis direction to allow the rotational movement of the lid 120 around an axis corresponding to the folding line, thereby either covering or exposing the dispensing unit 110.

The lower face of the lid 120 has the flange 121, which comes in contact with the upper annular portion 112*b* of the dispensing unit 110 when the dispensing unit 110 is placed in the closed state.

The flange 121 projects in tubular form from the lower face of the lid 120. When the lid 120 covers the dispensing unit 110, the outer perimeter of the upper annular portion 112*b* is inserted into the flange 121 to come in contact with the inner perimeter of the flange 121.

Engagement of the upper annular portion 112*b* with the flange 121, when the lid 120 closes the dispensing unit 110, provides airtight closure, thereby preventing drying of the wet-type tissue wipes P inside the case 101.

Alternatively, the upper face of the upper annular portion 112*b* may come in contact with the lower face of the lid 120 inside the flange 121 to provide airtight closure.

As illustrated in FIG. 7-(*a*), the upper face of the upper annular portion 112*b* may be such that the center of the annular band bulges upward to form a curved surface. The flange 121 may come in contact with the outer perimeter of the upper annular portion 112*b* to provide airtight closure.

Alternatively, as illustrated in FIG. 7-(*b*), the upper face of the upper annular portion 112*b* may have a groove 112*b*1 formed therein, into which the flange 121 is inserted to provide airtight closure.

In the following, the way in which the tissue wipes P are pulled out from the tissue wipe container 100 will be described.

In an unused state, i.e., when the lid 120 is in the closed position, airtight closure is maintained because the flange 121 of the lid 120 is in contact with the upper annular portion 112*b*.

Further, the end of a first sheet of the tissue wipes P contained inside is passed through the dispensing opening 113 of the dispensing unit 110 and held by the dispensing opening 113.

In this state, the position of the dispensing opening 113 at the base 111*a* of the recess 111 allows the tissue wipe P held by the dispensing opening 113 to be accommodated inside the recess 111. Namely, the closed state of the lid 120 is not obstructed, and the tissue wipe P is prevented from sticking out from the lid 120.

In order to use the tissue wipe P, the lid 120 is flipped to the open position, and the user pulls up the tissue wipe P held by the dispensing opening 113 to remove the tissue wipe P.

Since the distal ends of the flexible parts 114 are thinner than the proximal ends, the flexible parts 114 are readily bent by the force applied from below, thereby providing resistance to the tissue wipes P. The tissue wipe P is thus separated along a perforation. The next tissue wipe P receives a restoration force from the flexible parts 114, so that the next tissue wipe P will consequently be held at the dispensing opening 113.

The user may press down the dispensing unit 110 when handling the tissue wipes P, or the dispensing unit 110 may is subjected to a force applied from below by the tissue wipes P at the time of pulling out the tissue wipes P. The dispensing unit 110 is engaged with the mount opening 106 such that the edge of the mount opening 106 of the case 101 is inserted into the constricted portion 112*a* of the engaging part 112, and the edge of the mount opening 106 is sandwiched between the upper annular portion 112*b* and the lower annular portion 112*c*. The dispensing unit 110 is thus unlikely to become disengaged from the mount opening 106.

According to the present embodiment as described above, the tissue wipe container 100 includes the case 101 storing therein a roll of tissue wipes P with perforations and having the dispensing unit 110 through which the stored tissue wipes P are pulled out to the outside upon being separated along the perforations, and further includes the lid 120 attached to the case 101 to cover and expose the dispensing unit 110. The dispensing unit 110 includes the engaging part 112 for engaging the dispensing unit 110 with the case 101, and includes the plurality of flexible parts 114 which are elastically deformable and formed by making one or more cuts. The engaging part 112 has the constricted portion 112*a* formed in the side surface of the dispensing unit 110 at the center in the vertical direction along the circumferential direction. The engaging part 112 is engaged with the mount opening 106 by inserting the edge of the mount opening 106 of the case 101 into the constricted portion 112*a* The plurality of flexible parts 114 has the thickness of the distal ends thinner than the thickness of the proximal ends. The tissue wipes P are passed through the gaps between the flexible parts 114 for removal of the tissue wipes P to the outside.

With this arrangement, the dispensing unit 110 is unlikely to disengage regardless of from which direction a force is applied to the dispensing unit 110 through the engaging part 112, which makes it easy to pull out the tissue wipes P.

Further, the distal ends of the flexible parts 114 are bent to cause the flexible parts 114 to provide resistance to the tissue wipes P, which provides satisfactory retention.

Moreover, the present embodiment provides the flexible parts 114 each having the thickness thereof decreasing toward the tip.

This arrangement makes it easier for the flexible parts 114 to bent, which allows an increased resistance to be provided to the tissue wipes P, thereby providing more satisfactory retention.

According to the present embodiment, the flexible parts 114 may have the steps 114*a* between the distal ends and the proximal ends.

This arrangement makes it easier for the flexible parts 114 to bent, which allows an increased resistance to be provided to the tissue wipes P, thereby providing more satisfactory retention.

Further, according to the present embodiment, the flexible parts 114 are such that a plurality of separate sheets 1141 and 1142 having different lengths are stacked one over another such as to provide a thicker proximal end (such as to provide a relatively large number of stacked sheets at the proximal end).

This arrangement makes it easier for the flexible parts 114 to bend, which allows an increased resistance to be provided to the tissue wipes P, thereby providing more satisfactory retention.

Moreover, according to the present embodiment, the recess 111 depressed in the vertical direction is provided in the upper face of the dispensing unit 110, with the flexible parts 114 being formed in the base 111*a* of the recess 111.

The tissue wipe P held by the dispensing opening 113 is thus accommodated inside the recess 111, which ensures that the closed state of the lid 120 is not obstructed and the tissue wipe P is prevented from sticking out from the lid 120.

Figure 8:
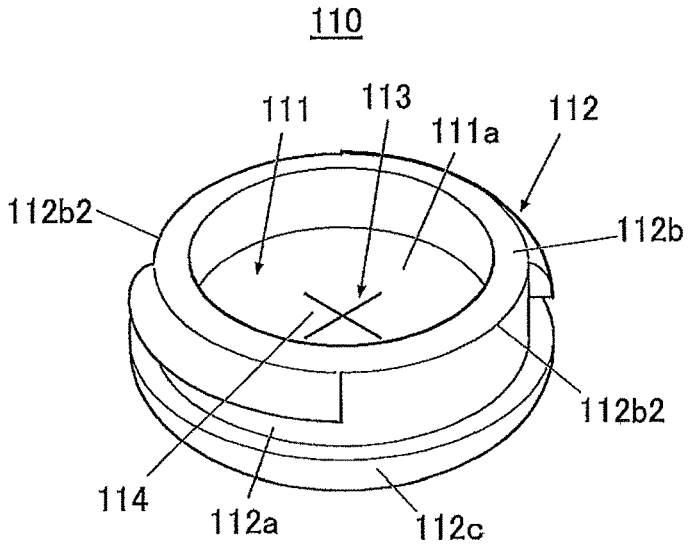
FIG. 8 is a drawing for explaining a variation of the dispensing unit.

The present embodiment has been described by using an example in which the constricted portion 112*a* is formed in the side surface of the dispensing unit 110 at the center in the vertical direction along the entire circumference (see FIG. 3). However, this is not a limiting example. For example, as illustrated in FIG. 8, the upper annular portion 112*b* may have notches 112*b*2, so that the constricted portion 112*a* may be formed at intervals in the circumferential direction without covering the entire circumference. In this arrangement, the number of notches 112*b*2 is not particularly limited.

Although graphical illustration is not provided, the configuration may be such that the lower annular portion 112*c* has notches, or both the upper annular portion 112*b* and the lower annular portion 112*c* have notches.

The configuration in which the constricted portion 112*a* is formed at intervals along the circumferential direction without covering the entire circumference improves the ease of attaching the dispensing unit 110 to the cap 103.

The above-described embodiments have been described with reference to an example in which the lid 120 has the flange 121 at the lower face. Alternatively, a configuration having no flange 121 may be used as long as airtight closure is provided for the dispensing unit 110 and the lid 120.

For example, the upper face of the upper annular portion 112*b* may have a curved surface upwardly bulging at the center of the annular band. Without having the flange 121, the lid 120 may have, at the lower face, a lid depression that comes in contact with the curved surface shape of the upper face of the upper annular portion 112*b*.

The present application is based on priority application No. 2016-067119 filed in Japan on Mar. 30, 2016, the entire contents of which are hereby incorporated by reference.

DESCRIPTION OF REFERENCE SYMBOLS

100 tissue wipe container
101 case
102 bottle
103 cap
103*a* upper face
104 recess
106 mount opening
110 dispensing unit
111 recess
111*a* base
112 engaging part
112*a* constricted portion
112*b* upper annular portion
112*b*1 groove
112*b*2 notch
112*c* lower annular portion
113 dispensing opening
114 flexible part
114*a* step
120 lid (lid member)
121 flange
1141, 1142 sheet
P tissue wipes

The invention claimed is:

1. A tissue wipe container, comprising a case which stores therein a roll of tissue wipes with perforations and which is provided with a dispensing unit for pulling out the stored tissue wipes to an outside upon being separated along the perforations, and a lid attached to the case in such a manner as to expose and cover the dispensing unit, wherein the dispensing unit has an engaging part for engaging the dispensing unit with the case, and has a flat plate part having one or more cuts made thereinto that serve as an opening through which the tissue wipes are passed, wherein the flat plate part includes a plurality of flexible parts, which are elastically deformable and separated from each other by the one or more cuts, and each of which has a distal end situated toward a center of the opening and a proximal end situated away from the center of the opening, wherein the engaging part has a constricted portion formed in a side surface of the dispensing unit at a vertical center of the side surface, the constricted portion extending in a circumferential direction of the dispensing unit, an edge of a mount opening of the case being inserted into the constricted portion to cause the engaging part to be engaged with the mount opening, wherein the plurality of flexible parts are such that a thickness of the distal end is thinner than a thickness of the proximal end, wherein the engaging part includes an upper annular portion and a lower annular portion, the upper annular portion defining an upper side of the constricted portion, the lower annular portion defining a lower side of the constricted portion, and wherein the upper annular portion, the lower annular portion, and the constricted portion are continuously formed without any gap along a whole circumference of the engaging part.

2. The tissue wipe container as claimed in claim 1, wherein the plurality of flexible parts has a thickness decreasing toward a tip.

3. The tissue wipe container as claimed in claim 1, wherein the plurality of flexible parts have a step between the distal end and the proximal end.

4. The tissue wipe container as claimed in claim 1, wherein the plurality of flexible parts have a configuration in which a plurality of sheets having different lengths are stacked one over another such that a number of overlapping sheets at the proximal end is greater than a number of overlapping sheets at the distal end.

5. The tissue wipe container as claimed in claim 1, wherein an upper face of the dispensing unit is recessed in the vertical direction to form a recess, and the plurality of flexible parts are formed in a base of the recess.

6. A tissue wipe container, comprising a case which stores therein a roll of tissue wipes with perforations and which is provided with a dispensing unit for pulling out the stored tissue wipes to an outside upon being separated along the perforations, and a lid attached to the case in such a manner as to expose and cover the dispensing unit, wherein the dispensing unit has an engaging part for engaging the dispensing unit with the case, and has a flat plate part having one or more cuts made thereinto that serve as an opening through which the tissue wipes are passed, wherein the flat plate part includes a plurality of flexible parts, which are elastically deformable and separated from each other by the one or more cuts, and each of which has a distal end situated toward a center of the opening and a proximal end situated away from the center of the opening, wherein the engaging part has a constricted portion formed in a side surface of the dispensing unit at a vertical center of the side surface, the constricted portion extending in a circumferential direction of the dispensing unit, an edge of a mount opening of the case being inserted into the constricted portion to cause the engaging part to be engaged with the mount opening, wherein the plurality of flexible parts are such that a thickness of the distal end is thinner than a thickness of the proximal end, wherein the engaging part includes an upper annular portion and a lower annular portion, the upper annular portion defining an upper side of the constricted portion, the lower annular portion defining a lower side of the constricted portion, and wherein the upper annular portion, the lower annular portion, and the constricted portion are continuously formed without any gap along a whole circumference of the engaging part, and together constitute a barrel shape that has a cut in a circumferential surface thereof at a vertical center.

7. A tissue wipe container, comprising a case which stores therein a roll of tissue wipes with perforations and which is provided with a dispensing unit for pulling out the stored tissue wipes to an outside upon being separated along the perforations, and a lid attached to the case in such a manner as to expose and cover the dispensing unit, wherein the dispensing unit has an engaging part for engaging the dispensing unit with the case, and has a flat plate part having one or more cuts made thereinto that serve as an opening through which the tissue wipes are passed, wherein the flat plate part includes a plurality of flexible parts, which are elastically deformable and separated from each other by the one or more cuts, and each of which has a distal end situated toward a center of the opening and a proximal end situated away from the center of the opening, wherein the engaging part has a constricted portion formed in a side surface of the dispensing unit at a vertical center of the side surface, the constricted portion extending in a circumferential direction of the dispensing unit, an edge of a mount opening of the case being inserted into the constricted portion to cause the engaging part to be engaged with the mount opening, wherein the plurality of flexible parts are such that a thickness of the distal end is thinner than a thickness of the proximal end, wherein the engaging part is made of a silicon rubber or a thermoplastic elastomer, and is a barrel shape that has a cut in a circumferential surface thereof at a vertical center, the cut serving as the constricted portion, wherein the engaging part includes an upper annular portion and a lower annular portion, and wherein the upper annular portion, the lower annular portion, and the constricted portion are continuously formed without any gap along a whole circumference of the engaging part.

* * * * *